US005605498A

United States Patent [19]

Nauche

[11] Patent Number: 5,605,498

[45] Date of Patent: Feb. 25, 1997

[54] MACHINE FOR TRIMMING EYEGLASS LENSES

[75] Inventor: Michel Nauche, Soisy S/Montmorency, France

[73] Assignee: Essilor International Cie Generale d'Optique, Charenton le Pont, France

[21] Appl. No.: 318,114

[22] Filed: Oct. 5, 1994

[30] Foreign Application Priority Data

Oct. 19, 1993 [FR] France ..... 93 12420

[51] Int. Cl.[6] ..... B24B 7/00

[52] U.S. Cl. ..... 451/240; 451/256; 451/237

[58] Field of Search ..... 451/42, 43, 236, 451/237, 239, 240, 242, 246, 256, 379, 384, 385, 397, 398; 83/565; 409/126, 125, 130

[56] References Cited

U.S. PATENT DOCUMENTS

| | | | |
|---|---|---|---|
| 2,410,443 | 11/1946 | Hoffer | 451/240 |
| 3,210,890 | 10/1965 | Lannom | 451/240 |
| 4,512,108 | 4/1985 | Kobayashi | 451/240 |
| 4,633,618 | 1/1987 | Kobayashi | 451/240 |
| 4,637,168 | 1/1987 | Kötting et al. | 451/240 |
| 4,885,875 | 12/1989 | Soper | 451/41 |
| 4,945,684 | 8/1990 | Wada et al. | 451/240 |
| 4,964,239 | 10/1990 | Gottschald et al. | 451/240 |
| 5,161,333 | 11/1992 | Lecerf et al. | 451/41 |
| 5,398,460 | 3/1995 | Joncour | 451/240 |

FOREIGN PATENT DOCUMENTS

| | | | |
|---|---|---|---|
| 280900 | 12/1914 | Germany . | |
| 7903025 | 5/1979 | Germany . | |
| 2159739 | 12/1985 | United Kingdom | 451/240 |

*Primary Examiner*—Bruce M. Kisliuk
*Assistant Examiner*—Eileen P. Morgan
*Attorney, Agent, or Firm*—Young & Thompson

[57] ABSTRACT

An eyeglass lens trimming machine includes spring arrangements operative between a carriage and a chassis to urge the carriage towards an associated feeler. The feeler being mobile on the chassis, auxiliary spring arrangements between it and the carriage also urge the carriage towards the feeler.

8 Claims, 1 Drawing Sheet

MACHINE FOR TRIMMING EYEGLASS LENSES

BACKGROUND OF THE INVENTION

1. Field of the Invention

The present invention is generally concerned with machines for carrying out the machining or trimming that is normally required to match the contour of an eyeglass lens to that of the rim or surround of the eyeglass chassis to which it is to be fitted.

2. Description of the Prior Art

It is more particularly concerned with machines of this kind which include at least one cutting tool, such as a grinding wheel or a milling cutter, rotatably mounted on a chassis, a carriage mounted to pivot on the chassis about an axis parallel to the rotation axis of the cutting tool, a support spindle mounted on the carriage to rotate about an axis parallel to the rotation axis of the cutting tool and adapted to receive the lens to be machined axially and in vertical alignment with the cutting tool, a template spaced from the lens and a feeler, usually called a vernier head, carried by the chassis in vertical alignment with the template to support the carriage through the intermediary of the template and so to halt at a set point the relative interengagement of the glass and the cutting tool.

The template can have the exact contour of the rim or surround of the eyeglass chassiss to which the lens is to be fitted, in which case the feeler can be fixed.

Alternatively, the template can have a circular contour in which case the associated feeler is mobile on the chassis under the control of control means which output shape data transmitted to them by a contour reading device operating on the rim or surround of the eyeglass chassis to which the lens is to be fitted, imposing an instantaneous set point of the feeler for a given angular orientation of the support spindle carrying the lens to be machined.

In all cases an appropriate bearing load must be provided between the lens and the cutting tool.

This bearing load is usually the result of the combined effect of the weight of the carriage and the action of ancillary means provided for this purpose.

For example, these ancillary means can include a counterweight mounted on the carriage with its transverse position relative to the carriage pivot axis adjustable.

Although adjusting the counterweight advantageously varies the bearing load that it produces, by variation of the lever arm, it has the drawback of being bulky and costly.

The ancillary means employed can instead include spring means.

At present these spring means, which are in the form of a prestressed spring, for example, are disposed between the carriage and the chassis and so are adapted to urge the carriage towards the feeler carried by the chassis.

However, the bearing load that they produce at the lens being machined is difficult to adjust and increases as the diameter of the lens is reduced.

For some applications at least, for example when trimming a thin or fragile lens, it is desirable to use a moderate bearing load which is kept constant, whereas in other applications, for example for trimming a standard lens, it is possible to use a higher initial bearing load and to accept some subsequent variation in the load.

A general object of the present invention is to provide an arrangement which meets this two-fold requirement in a very simple manner.

SUMMARY OF THE INVENTION

The present invention consists in a machine for trimming eyeglass lens including at least one cutting tool such as a grinding wheel or a milling cutter mounted to rotate on a chassis, a carriage which is mounted to pivot on said chassis about an axis parallel to the rotation axis of said cutting tool, a support spindle mounted to rotate on said carriage about an axis parallel to the rotation axis of said cutting tool and adapted to receive axially and in vertical alignment with said cutting tool the lens to be machined and, at a distance from said lens, a template, and a feeler carried by said chassis in vertical alignment with said template with spring means operative between said carriage and said chassis to urge said carriage towards said feeler, in which machine, said feeler being mobile relative to said chassis, there is provided between said feeler and said carriage, in addition to main spring means operative between said carriage and said chassis auxiliary spring means also adapted to urge said carriage towards said feeler.

The effect of the auxiliary spring means is added in operation to the effect of the main spring means, the auxiliary spring means providing an additional bearing load.

For example, the maximum additional bearing load is only a fraction of that due to the main spring means.

Because the feeler is mobile, it is advantageously possible to modulate this bearing load at will, obtaining a further and advantageous benefit from this mobility.

For example, the design can be such that when the template carried by the carriage is in contact with the feeler, which occurs in particular for the position of the carriage when the machined lens has been trimmed to the required size, this additional bearing load is substantially zero.

Consequently, this is also the case when the template is not far away from the feeler.

To minimize this additional bearing load during machining, if necessary, the feeler merely has to be at all times at only a small distance from the template, its displacement being controlled accordingly.

In accordance with the invention, this feeler being acted on by displacement control means, the latter are to this end themselves under the control of control means for temporarily imparting to the feeler, if required, and for a given angular orientation of the support spindle carrying the lens, a location closer to the template than the normal set point for machining the lens in this angular orientation of the support spindle.

In this case most of the bearing load is therefore due to the main elastic means only, the auxiliary elastic means being inhibited, so to speak.

This bearing load is then substantially constant and the design can be such that it is relatively moderate, i.e. perfectly suitable for machining a thin or fragile lens.

This advantageously reduces the risk of a thin or fragile lens breaking.

Instead of offsetting the feeler from the normal set point, as previously, the feeler can be brought directly to this set point for machining a standard lens.

The additional bearing load produced by the auxiliary spring means then assumes its full value, decreasing thereafter as machining proceeds.

This has the advantage of reducing the time to machine a standard lens.

In all cases, at the end of machining only the bearing load due to the main spring means is operative, since the additional bearing load due to the auxiliary spring means is then substantially zero.

An advantageous result of this is better conformance of shapes and dimensions at this stage in machining.

It is also and advantageously possible to benefit from the main spring means to hold the carriage in a raised rest position between two machining cycles.

To achieve this the point at which they act on the carriage merely has to be beyond the latter's pivot axis relative to their point of attachment to the chassis.

The features and advantages of the invention will emerge from the following description given by way of example with reference to the appended diagrammatic drawings.

DETAILED DESCRIPTION OF THE PREFERRED EMBODIMENT

As shown in the figures, the overall aim is to machine an eyeglass lens 10 on a trimming machine 11 to trim it to size so that it can be fitted to one of the rims or surrounds of a specific eyeglass chassis (not shown).

Figure 1:
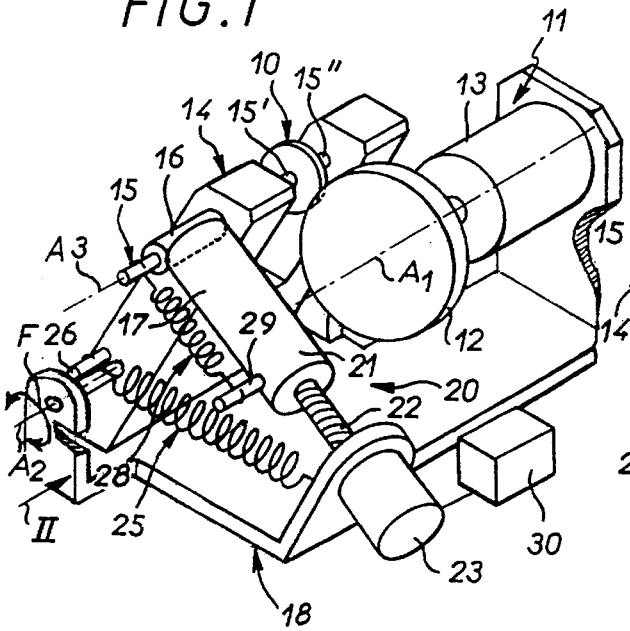
FIG. 1 is a perspective view of a trimming machine of the invention showing the position of the carriage at the end of machining.

In a manner that is known in itself the trimming machine 11 includes at least one cutting tool 12 such as a grinding wheel or a milling cutter, for example, which is rotated by a motor 13 on a chassis (not shown in detail) about a rotation axis A1 shown diagrammatically in chain-dotted line in FIG. 1, a carriage 14 mounted on the chassis to pivot about an axis A2 parallel to the rotation axis A1 of the cutting tool 12, as shown by the double-headed arrow F in FIG. 1, this axis being shown diagrammatically in chain-dotted line in FIG. 1, a support spindle 15 which is mounted on the carriage 14 to rotate about an axis A3 also diagrammatically shown in chain-dotted outline in FIG. 1 and also parallel to the rotation axis A1 of the cutting tool 12, and which is adapted to receive axially the eyeglass lens 10 to be machined in vertical alignment with the cutting tool 12 and is formed, for example and as shown here, by two half-spindles 15', 15" adapted to grip axially between them the lens 10 previously fitted with appropriate holding means, and—at a distance from the lens 10 and as described in more detail below—a template 16 with a feeler 17 usually called a vernier head carried by the chassis in vertical alignment with the template 16.

In the embodiment shown the template 16 has a circular contour and the feeler 17 is mounted so that it is mobile on the chassis, as described in more detail later.

As shown here, for example, the template 16 can be a drum sleeved onto the end of the support spindle 15.

Alternatively, it can be a disk.

To simplify the figures only part of the chassis, namely a bracket 18 has been shown.

The feeler 17 is carried by the bracket 18 and is under the control of displacement control means 20.

In the embodiment shown the displacement control means 20 include a nut 21 which carries the feeler 17 or itself forms the feeler 17, a screw 22 with which the nut 21 meshes and which is rotatably mounted on the chassis, to be more precise on the bracket 18, and a motor 23 which is also supported by the bracket 18 and whose output spindle 24 rotates the screw 22 or itself forms the screw 22.

To be more precise, in this embodiment the nut 21 itself forms the feeler 17 and the output spindle 24 of the motor 23 itself forms the screw 22.

The nut 21 and the screw 22 preferably constitute a recirculating ball screw device.

Between the carriage 14 and the chassis are spring means 25 adapted to urge the carriage 14 towards the feeler 17.

In the embodiment shown these main spring means 25 comprise a prestressed tension spring coupled to the carriage 14 at one end and to the bracket 18 at the other end.

As shown, the main spring means 25 operate on the carriage 14 via a pin 26 projecting laterally from the latter, parallel to its pivot axis A2 and preferably beyond pivot axis A2 relative to their point of attachment 27 to the chassis, i.e. to the bracket 18.

Figure 2:
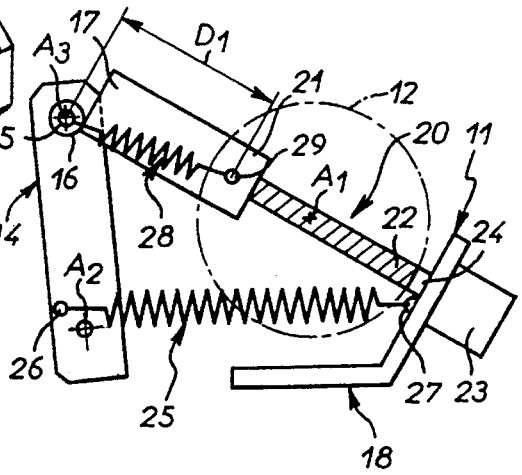
FIG. 2 is an end view in the direction of the arrow II in FIG. 1 showing the raised rest position of the carriage to a larger scale.
Figure 3:
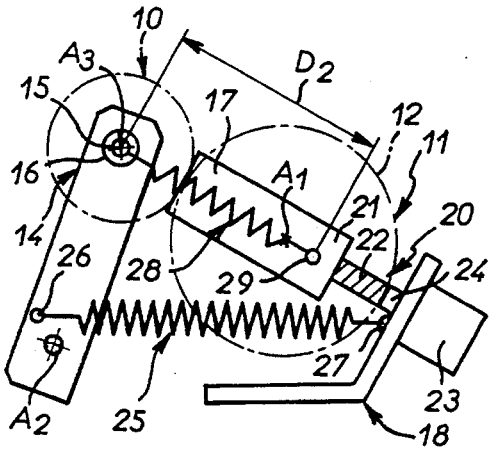
FIG. 3 is an end view analogous to that of FIG. 2 for any position of the carriage when machining a standard lens.
Figure 5:
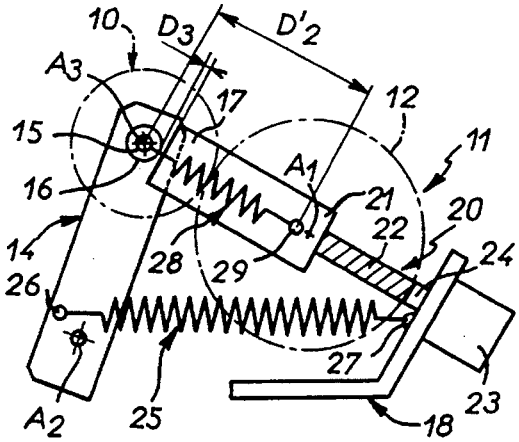
FIG. 5 is an end view analogous to that of FIG. 3 for any position of the carriage during machining of a fragile lens.
Figure 4:
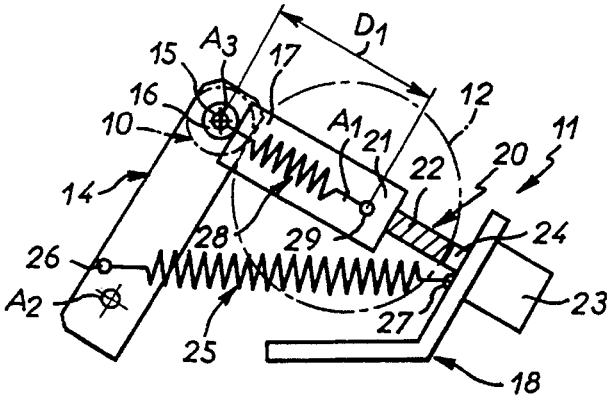
FIG. 4 is an end view also analogous to that of FIG. 2 for the position of the carriage at the end of machining.

As a result, by crossing a top dead center position corresponding to the pivot axis A2 of the carriage 14, the main spring means 25 can either urge the carriage 14 towards the feeler 17, as when machining a lens 10, as shown in FIGS. 3 to 5, or urge the carriage 14 away from the feeler 17, as in the raised rest position shown in FIG. 2.

The design is preferably such that the main spring means 25 are relaxed in this raised rest position of the carriage 14.

In accordance with the invention, auxiliary spring means 28 are provided between the carriage 14 and the feeler 17, in addition to the main spring means 25 operative between the carriage 14 and the chassis. The auxiliary spring means 28 also urge the carriage 14 towards the feeler 17.

In the embodiment shown the auxiliary spring means 28 comprise a tension spring coupled to the carriage 14 at one end and to the feeler 17 at the other end.

For example, this tension spring is coupled at one end to the support spindle 15 on the carriage 14 and at the other end to a pin 29 projecting laterally for this purpose from the nut 21 forming the feeler 17, parallel to the support spindle 15.

By design, and in particular by an appropriate choice of the tension springs employed, the maximum bearing load produced at the lens 10 by the auxiliary spring means 28 is only a fraction of that produced by the main spring means 25.

This fraction is in the order of one-third, for example.

To be more precise, in a particularly satisfactory embodiment the force exerted on the carriage 14 by the tension spring constituting the main spring means 25 is in the order of approximately 3 kg while that exerted by the tension spring constituting the auxiliary spring means 28 is in the order of approximately 1 kg.

Of course, the numerical values given above must in no way be regarded as limiting on the invention.

When the template 16 carried by the carriage 14 is in contact with the feeler 17, the bearing load produced at the lens 10 by the auxiliary spring means 28 is preferably substantially zero.

This applies, in particular, in the raised rest position of the carriage 14 shown in FIG. 2 which is obtained in practise by appropriately displacing the feeler 17, which pushes back the carriage 14 until the tension spring constituting the main spring means 25 passes its pivot axis A2.

In this raised rest position of the carriage 14 both this tension spring and that constituting the auxiliary spring means 28 are therefore relaxed.

Let D1 denote the distance at this time between the points of attachment of the auxiliary spring means 28, one of which is the support spindle 15 and the other the pin 29.

Referring to FIGS. 3 and 4, assume first that the lens 10 to be machined is a sufficiently rugged standard lens.

For each angular orientation of the support spindle 15 carrying the lens 10, the feeler 17 is placed directly at the normal set point for machining the lens.

As shown in FIG. 1, for example, the displacement control means 20 of the feeler 17 can to this end be under the control of control means 30 outputting shape data that they receive from a contour reading device (not shown).

As the control means 30 do not form any part of the present invention they are not described here.

The set point of the feeler 17 is such that the feeler 17 is separated from the template 16 and the points of attachment of the tension spring constituting the auxiliary spring means 28 are themselves separated by a distance D2 (FIG. 3) greater than the distance D1.

This tension spring is therefore tensioned and its effects are therefore combined with those of the tension spring constituting the main spring means 25.

As the lens 10 is machined the distance D2 decreases until at the end of machining it is equal to the distance D1, as shown in FIG. 4.

The tension spring constituting the auxiliary spring means 28 is relaxed at this time and the bearing load at the lens 10 is due only to the main spring means 25.

Referring to FIG. 5, assume now that the lens 10 to be machined is a thin or fragile lens.

For any given angular orientation of the support spindle 15 the feeler 17 is temporarily assigned a set point relative to the template 16 which is less than the normal set point for machining the lens 10 in this angular orientation of the support spindle 15.

The corresponding distance D'2 is therefore less than the distance D2.

In other words, the distance D3 between the feeler 17 and the template 16 is systematically kept small throughout the machining of the lens 10.

The control means 30 are naturally adapted accordingly.

In other words, they are adapted to enable temporary assignment to the feeler 17 of a position closer than the set point.

Thus throughout machining of the lens 10 the tension spring constituting the auxiliary spring means 28 is relaxed, or virtually so.

In other words, throughout its machining the lens 10 is subjected only to the bearing load produced by the main spring means 25, the auxiliary spring means 28 being inhibited, so to speak.

Of course, the present invention is not limited to the embodiment described and shown, but encompasses any variant execution thereof.

There is claimed:

1. Machine for trimming eyeglass lens comprising at least one cutting tool, such as grinding wheel or a milling cutter, mounted on a chassis to rotate about a rotation axis, a carriage pivotally mounted on the chassis about an axis parallel to the rotation axis of the cutting tool, a support spindle mounted to rotate on the carriage about an axis parallel to the rotation axis of said cutting tool and adapted to support a lens to be trimmed co-axially of the rotation axis of the support spindle and in vertical alignment with the cutting tool, a template carried by said support spindle and spaced from said lens, a feeler carried by said chassis and mounted for movement in relation to the chassis, said feeler being disposed in vertical alignment with said template for cooperation therewith, main spring means operatively disposed between said carriage and the chassis, and auxiliary spring means operatively disposed between said carriage and said feeler, said chassis and auxiliary spring means both arranged to urge said carriage towards said feeler.

2. Trimming machine according to claim 1 wherein said auxiliary spring means is calibrated to produce a maximum bearing load at the lens which is a fraction of the maximum bearing load produced by said main spring means.

3. Trimming machine according to claim 1 wherein said auxiliary spring means is calibrated to produce a maximum bearing load at the lens which is about one-third of a maximum bearing load produced by said main spring means.

4. Trimming machine according to claim 1 wherein, when said template carried by said carriage is in contact with said feeler, a substantially zero bearing load is produced by said auxiliary spring means at the lens.

5. Trimming machine according to claim 1 further comprising displacement control means for temporarily locating said feeler relative to said template at a position closer than that of a normal set point for machining the lens for a given angular orientation of said support spindle.

6. Trimming machine according to claim 1 further comprising displacement control means for controlling said feeler, said displacement control means comprising nut means fixed relative to said feeler, screw means meshing with said nut and mounted to rotate relative to said chassis, and a motor having an output spindle means for driving said screw means.

7. Trimming machine according to claim 1 wherein said main spring means acts on said carriage at a location beyond the rotation axis of said carriage relative to a point of attachment of said main spring means to said chassis.

8. Trimming machine according to claim 1 wherein said main spring is also arranged to urge said carriage away from said feeler a rest position.

* * * * *